US007175140B2

(12) United States Patent
Johnson et al.

(10) Patent No.: US 7,175,140 B2
(45) Date of Patent: Feb. 13, 2007

(54) MOUNTING APPARATUS AND METHOD FOR USE WITH A TILE ROOF

(75) Inventors: Marvin D. Johnson, Goodyear, AZ (US); Eric Bolze, Phoenix, AZ (US); Alejandro Gonzalez, Phoenix, AZ (US)

(73) Assignee: Infinite Innovations Incorporated, Phoenix, AZ (US)

( * ) Notice: Subject to any disclaimer, the term of this patent is extended or adjusted under 35 U.S.C. 154(b) by 0 days.

(21) Appl. No.: 10/235,725

(22) Filed: Sep. 4, 2002

(65) Prior Publication Data

US 2003/0042374 A1 Mar. 6, 2003

Related U.S. Application Data

(60) Provisional application No. 60/317,399, filed on Sep. 4, 2001.

(51) Int. Cl.
*A47G 23/02* (2006.01)

(52) U.S. Cl. ..... 248/148; 248/540; 248/124.2; 248/229.14; 248/231.41; 52/27

(58) Field of Classification Search ..... 248/124.2, 248/540, 229.14, 227.1, 227.2, 227.4, 228.3, 248/231.61, 226.11, 229.24; 52/27, 713, 52/699

See application file for complete search history.

(56) References Cited

U.S. PATENT DOCUMENTS

| | | | | |
|---|---|---|---|---|
| 757,547 | A * | 4/1904 | Gilbert | 248/216.4 |
| 1,764,071 | A | 6/1930 | Foulke | |
| 2,767,240 | A | 10/1956 | Webster et al. | |
| 2,940,715 | A * | 6/1960 | Schultz et al. | 248/231.41 |
| 3,100,241 | A | 8/1963 | Goldstein | |
| 3,984,076 | A | 10/1976 | Van Ordt | |
| 4,180,958 | A | 1/1980 | Brody | |
| D277,578 | S | 2/1985 | Nichols | |
| 4,599,828 | A | 7/1986 | Ishikura | |
| 5,142,293 | A | 8/1992 | Ross | |
| D329,052 | S | 9/1992 | Keane et al. | |
| 5,240,214 | A * | 8/1993 | Birnbaum et al. | 248/231.41 |
| 5,292,102 | A | 3/1994 | Hoover | |
| D345,906 | S | 4/1994 | Schmidt et al. | |
| 5,398,476 | A | 3/1995 | Knight | |
| 5,617,680 | A | 4/1997 | Beatty | |
| D387,064 | S | 12/1997 | Heine | |
| 5,746,029 | A | 5/1998 | Ullman | |

FOREIGN PATENT DOCUMENTS

| | | |
|---|---|---|
| GB | 2 236 337 | 4/1991 |
| GB | 2 299 897 | 10/1996 |
| JP | 61195003 A | 8/1986 |

* cited by examiner

*Primary Examiner*—Kimberly T. Wood
(74) *Attorney, Agent, or Firm*—The Law Firm of Gary F. Witting; Gary F. Witting

(57) ABSTRACT

A mounting assembly for securing a pedestal to a roof tile has a baseplate including a downwardly depending first hook at one end for receiving a first edge of the tile, an upwardly depending flange at an opposing end of the baseplate and a laterally extending stabilizer for engaging the surface of the tile. The mounting assembly includes a detachable bracket having an upwardly depending flange at one end and a downwardly depending second hook at an opposing end of the detachable bracket for receiving the second edge of the tile. The bracket is detachably coupled to the baseplate. The pedestal is secured to the baseplate.

8 Claims, 10 Drawing Sheets

MOUNTING APPARATUS AND METHOD FOR USE WITH A TILE ROOF

RELATED APPLICATION

This application claims the benefit of U.S. Provisional Application No. 60/317,399, filed Sep. 4, 2001, entitled "Mounting Apparatus and Method for Use with a Tile Roof," which is incorporated herein by reference.

BACKGROUND

This invention relates generally to securing objects to a tile roof. More particularly, it relates to an apparatus and method for mounting an object, such as a directional antenna, to a tile roof without altering or damaging the roof tiles and without compromising the integrity of the roof.

In recent years, advances in communications technology have resulted in a dramatic increase in the use of small aperture, directional, reflective antennas. In particular, with the spread of direct satellite television and microwave broadband Internet access, these antennas are commonly used to provide television, telephone, and Internet services for business or residential use. The antennas are generally affixed to a house, apartment building, or place of business for the transmission and/or reception of the electromagnetic signals associated with television, telephone or Internet service. The antennas are small in size and lightweight enough to facilitate relatively simple installation by a service technician or, in many instances, a homeowner.

The services for which these antennas are provided most frequently employ line-of-sight communication methods where the straight line path between the transmitting and receiving antennas must be unobstructed. For example, in a direct television application, the small aperture antenna used by a homeowner must point directly at the appropriate geosynchronously orbiting satellite. In another example, the antenna used by a homeowner for some broadband Internet access applications must have an unobstructed path directly to an antenna at the other end of the transmission link, typically located at some elevated location within the coverage area, such as a tower on the roof of a tall building. In many cases, the only location within a homeowner's lot or a business's grounds that satisfies the line of sight condition is atop the roof of a house, condominium, apartment building or office building. Mounting an antenna on the roof, however, can present obstacles to the installer, particularly when the building is roofed with tiles rather than with materials such as composition or wooden shingles. In many areas of the world, it is quite common for homes and other buildings to be roofed with concrete or composition tiles. These tiles are manufactured in various styles having different sizes and profiles. For example, in the southwestern United States, tiles often referred to as Spanish or Mexican tiles are popular. Concrete or composition roof tiles interlock and overlap to form an effective outer barrier of the roofing system. Such tiles, however, present a number of obstacles if one desires to mount a small aperture antenna, to the roof. Previously, to mount an antenna on a tile roof has required drilling holes in tiles or modifying tiles by similar operations, which is difficult to do and can jeopardize the integrity of the tile. This drawback also makes it difficult to mount other objects to the tile rooftop, including solar energy photo voltaic panels, ornamental and security lighting and flag poles, to name a few examples.

Given these difficulties, antennas commonly have been mounted to houses with tile roofs by attaching one or more wooden boards to the eaves of a house and affixing a pole to the boards. The pole may be as much as thirty feet in length, and the antenna is attached near the top of the pole. This practice can result in marginally acceptable antenna installation for several reasons. First, the eaves of many homes may not be structurally sound enough to provide the antenna with sufficient stability in the presence of high winds. Moreover, this type of insallation is difficult and labor intensive. It quite often requires the installer to work from a ladder and the installation is expensive compared to a typical installation onto a non-tiled roof. In addition, currently practiced installation methods for homes with tile roofs often render a result that is not aesthetically pleasing. In areas where homeowners' associations or similar bodies impose and enforce architectural and aesthetic restrictions, their often are no aesthetically acceptable methods for mounting small aperture antennas to tile roofs. Additionally, many individuals, families, and businesses who occupy buildings with tile roofs currently have no cost effective, practical method for attaching objects including security lighting, flag poles, and rooftop ornaments to the roof.

In addition to eliminating a homeowner or place of business from access to the advantages offered by communication links using roof mounted antennas, the use of current antenna installation practices deprives communication service companies of potential business opportunities. A service company such as a direct television or Internet connectivity provider will consider a site technically unacceptable in a case where the installation of an antenna onto a building with a tile roof is prohibitively expensive for the installer, is unacceptable aesthetically or structurally to the resident or business operator, or does not comply with applicable architectural restrictions.

In view of the above discussion, there exists a need for an apparatus and method for securing antennas and other objects to a tile roof. Accordingly, it is an object of the present invention to provide such an apparatus and method.

Another object of the invention is to provide such a mounting apparatus and method that is suitable for use with a large variety of roofing tile shapes and styles.

Still another object of the invention is to provide an apparatus and method for the mounting of objects to tile roofs that requires no modification to the roof tiles and preserves the integrity of the roof and building on which it is utilized.

Still another object of the invention is to provide such a mounting apparatus that can be installed using a standardized installation technique that can be easily and quickly performed with a minimum of installer instruction.

Yet another object of the invention is to provide such a mounting apparatus that yields a cost effective solution for mounting objects onto tile roofs by providing reduced labor and equipment costs.

Yet another object of the invention is to provide such a mounting apparatus that is compact and lightweight.

Another object of the invention is to provide such a mounting apparatus that exhibits excellent stability for roof-mounted objects under conditions of high wind velocity.

Still one other object of the invention is to provide such a mounting apparatus that is aesthetically pleasing.

Another object of the invention is to provide such a mounting apparatus that significantly reduces the number of technically unacceptable tile roof antenna installation sites for service providers.

Additional objects and advantages of the invention will be set forth in the description that follows, and in part will be apparent from the description, or may be learned by practice of the invention. The objects and advantages of the invention may be realized and obtained by the instrumentalities and combinations pointed out in the appended claims.

SUMMARY

To achieve the foregoing objects, and in accordance with the purposes of the invention as embodied and broadly described in this document, there is provided a novel mounting assembly for securing a pedestal to a roof tile having a first edge and an opposing second edge, opposing lateral edges, and a top surface that faces generally upward when the tile is positioned on a roof. The mounting assembly includes a baseplate having a first end and an opposing second end. The baseplate includes a first hook member extending from the baseplate first end and adapted to receive the first edge of the tile. A bracket is adapted to be detachably mounted to the baseplate second end and includes a second hook member adapted to receive the second edge of the tile. The mounting assembly also has means for mounting the pedestal to the baseplate.

In one advantageous embodiment, the mounting assembly has an upwardly depending flange extending from the baseplate second end, and the bracket has an upwardly depending flange at one end and the second hook member at an opposing braket end. The mounting assembly can have stabilizing means for stabilizing the baseplate laterally when it is mounted to the roof tile. The stabilizing means can include a generally planar member extending laterally from the baseplate. The baseplate can include a threaded boss disposed at a lateral portion of the baseplate and adapted to receive a stabilizing screw.

The means for mounting the pedestal to the baseplate can include a plurality of studs fixed to the baseplate and adapted to be secured to the antenna pedestal. The plurality of studs can include a plurality of threaded studs and the pedestal can include a plurality of mounting holes configured to receive the plurality of threaded baseplate studs. The means for mounting the pedestal to the baseplate can include a platform fixed to the baseplate, the platform having a plurality of studs fixed thereto and adapted to be secured to the antenna pedestal. The plurality of studs can include a plurality of threaded studs and the pedestal can include a plurality of mounting holes configured to receive the plurality of threaded platform studs.

The mounting assembly can have a stiffener member adapted to extend from the second end of the baseplate and over a top surface of a second roof tile adjacent to and overlapping the second edge of the roof tile.

There is also provided an embodiment of the mounting assembly for securing a pedestal to a roof having a plurality of roof tiles in lateral alignment, each roof tile having a first edge, an opposing second edge and two lateral edges. The mounting assembly includes a baseplate having a first end and an opposing second end and including a plurality of first hook members. Each first hook member extends from the baseplate first end and is adapted to receive the first edge of a tile of the plurality of roof tiles. The assembly has a plurality of brackets, each bracket being adapted to be detachably mounted to the baseplate second end and including a second hook member adapted to receive the second edge of a tile of the plurality of tiles. The assembly also has means for mounting the pedestal to the baseplate.

The invention provides a novel apparatus and method for securing an antenna or similar object onto a building with a tile roof. Using the apparatus and method of the present invention, an object such as a directional antenna, can be mounted to a tile roof without altering or damaging the roof tiles and without compromising the integrity of the roof. In addition, such an object can be mounted to some buildings for which there presently exists no acceptable technique for installing such objects.

BRIEF DESCRIPTION OF THE DRAWINGS

The accompanying drawings, which are incorporated in and constitute a part of the specification, illustrate the presently preferred embodiments and methods of the invention and, together with the general description given above and the detailed description of the preferred embodiments and methods given below, serve to explain the principles of the invention.

DESCRIPTION

Reference will now be made in more detail to the presently preferred embodiments and methods of the invention as illustrated in the accompanying drawings, in which like numerals refer to like parts throughout the several views.

Figure 1:
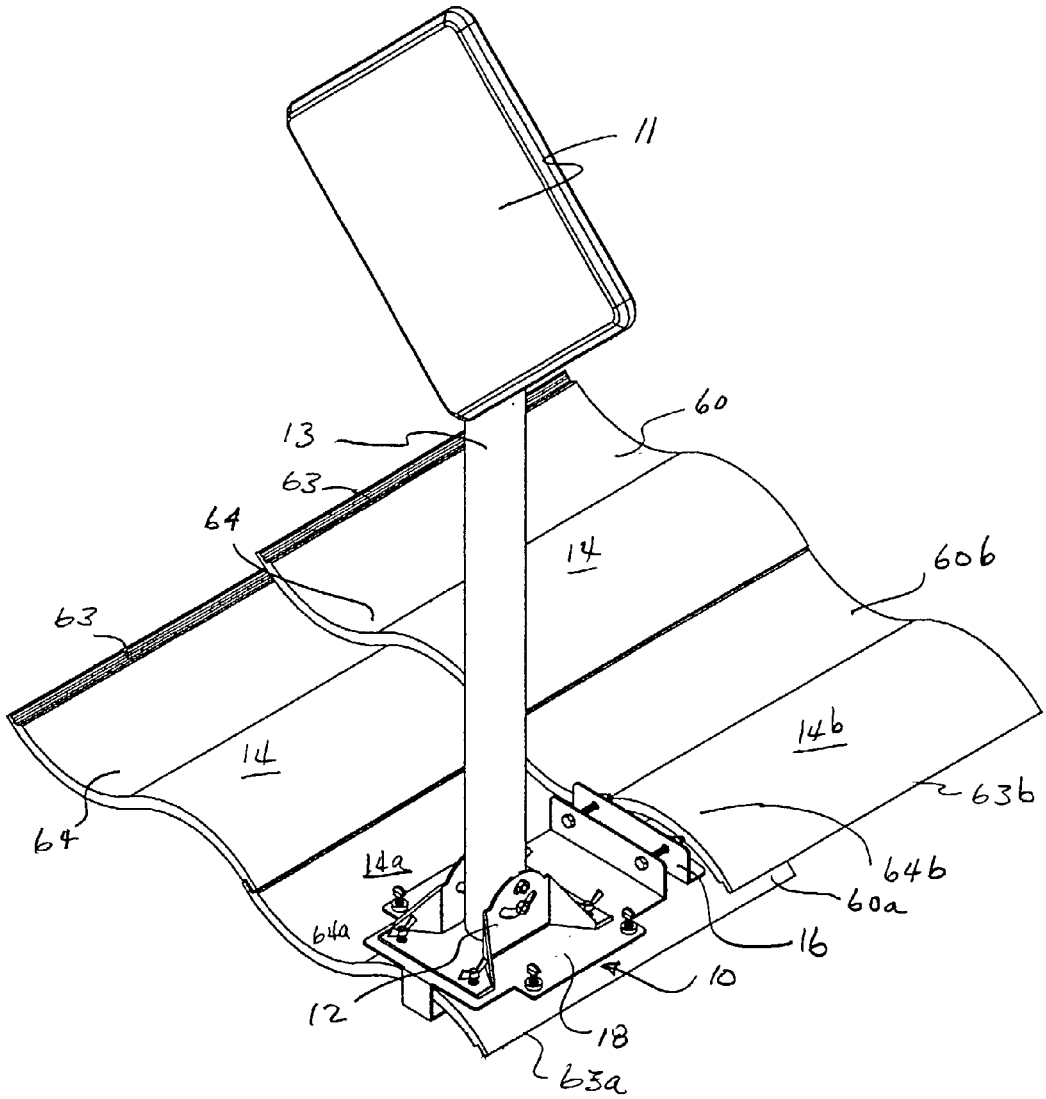
FIG. 1 is a perspective view of an antenna and mounting assembly mounted to a tile roof in accordance with the invention.

Referring to FIG. 1, one advantageous embodiment of a mounting assembly 10 is shown mounting an antenna 11 to a tile roof. Generally, roof tiles 14 are placed on the roof at a pitch such that the roof tiles 14 each have an upper end 60 and a lower end 64. The tiles 14 are placed in an overlapping arrangement such that the bottom end 64*b* of the overlapping tile 14*b* overlaps the upper end 60*a* of the overlapped tile 14*a*. Each of the tiles 14 has opposing lateral edges 63 configured to interlock with a laterally adjacent tile. The antenna 11 is supported on a support pole 13, which is coupled to an antenna pedestal 12. The pedestal 12 is fixed to a mounting assembly 10, which is mounted to a roof tile 14*a*.

Figure 2:
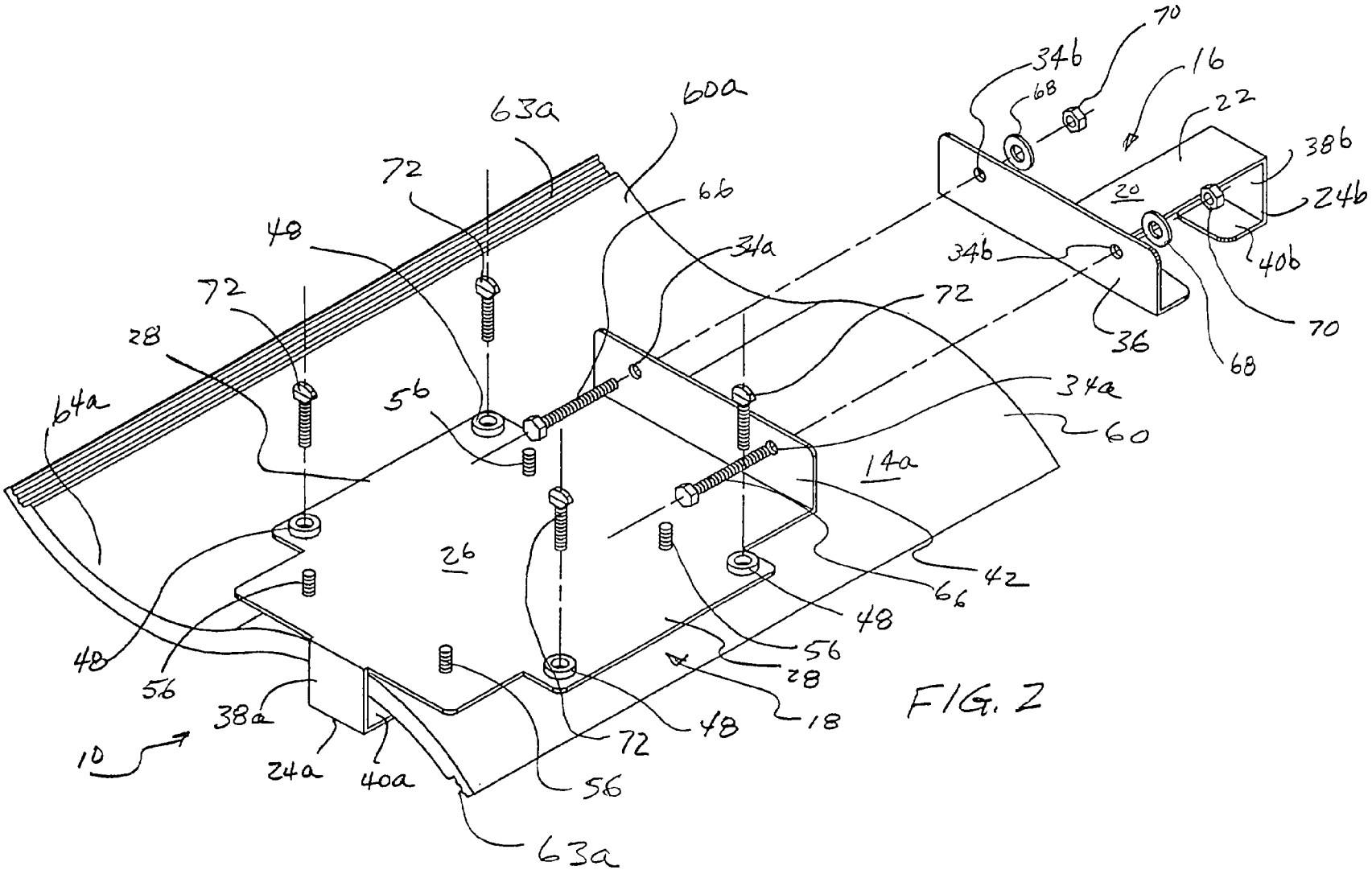
FIG. 2 is an enlarged view of the mounting assembly of FIG. 1 showing how it is mounted to a roof tile.
Figure 3:
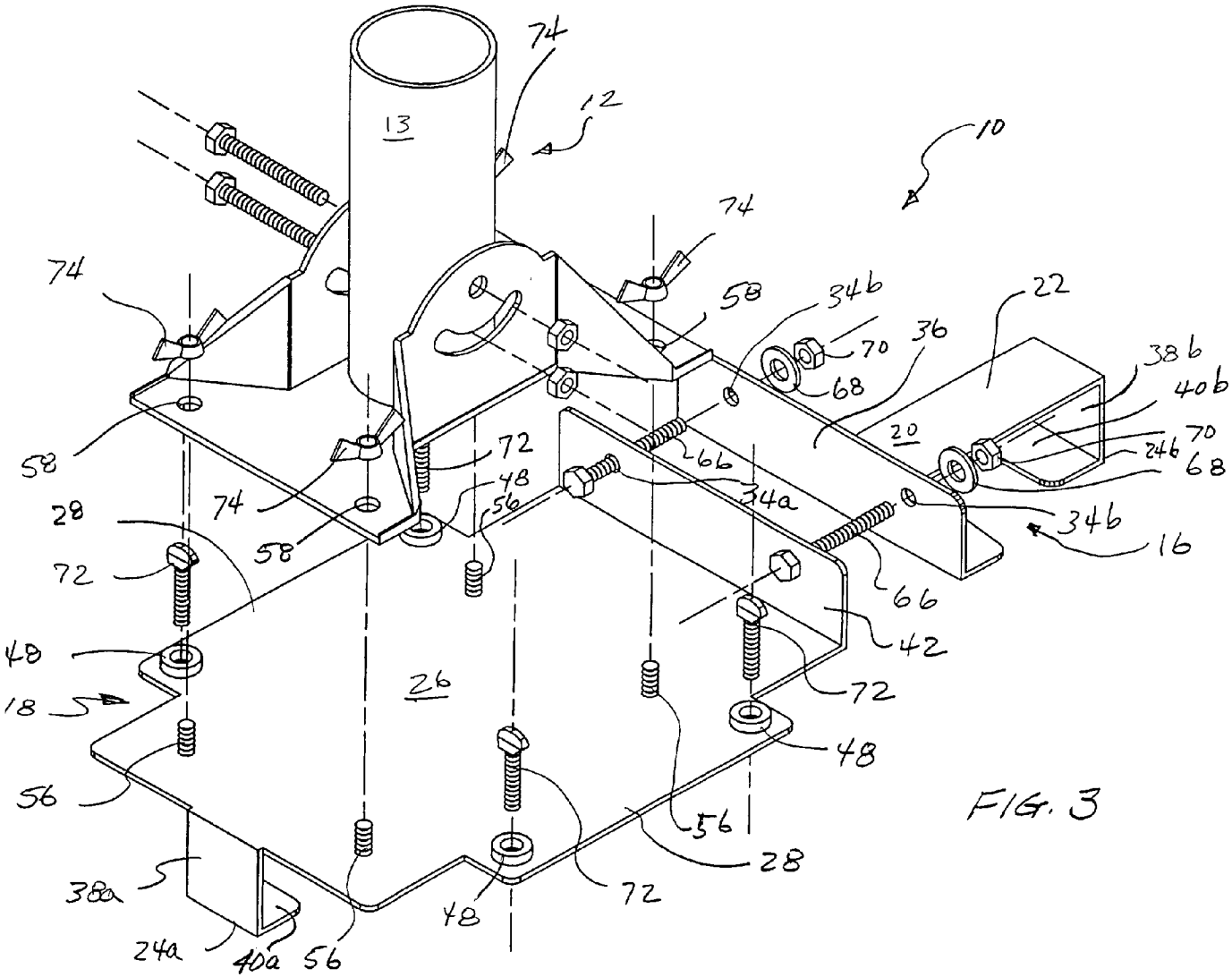
FIG. 3 is an exploded perspective view of the mounting assembly of FIG. 1 showing how the antenna pedestal is mounted to the baseplate.

FIGS. 2–3 illustrate in more detail the mounting assembly 10 shown in FIG. 1. The mounting assembly 10 comprises a detachable section 16 and a base section 18. The base section 18 includes a baseplate 26 having a downward depending hook member 24*a* at one end, an upward depending flange 42 at the opposing end and a stabilizing member 28 projecting laterally from each side. The baseplate hook 24*a* comprises a leg 38*a* extending downwardly from and substantially normal to the baseplate 26 and a tab 40*a* extending inwardly toward the baseplate flange 42, substantially normal to the leg 38*a*. The tab 40*a* is spaced from the baseplate 26 sufficiently to hook over an edge of the tile 14. The baseplate flange 42 extends generally normal to and upwardly from the baseplate 26 and includes a plurality of holes 34*a* for accepting screws, bolts or any other suitable connecting hardware.

Each of the stabilizing members 28 extends laterally from a side of the baseplate 26 for providing transverse support for the mounting assembly 10. In the embodiment of FIGS. 2–3, the stabilizing members 28 are coplanar to the baseplate 26. As will be obvious to one of ordinary skill in the art, the form and position of each stabilizing member 28 can be of any suitable shape, size and orientation that provides for transverse support for the mounting assembly 10. Threaded bosses 48 are provided on each stabilizing member 28 to accept stabilizing screws 72. The bosses 48 and stabilizing screws 72 are provided in a number and location on the stabilizing member 28 sufficient to adequately stabilize the article mounted by the mounting assembly 10. This is dependent upon the specific tile shape, the size of each stabilizing member 28, and the size and weight of the article to be mounted upon the roof. In the exemplary embodiment shown in FIGS. 2–3, two bosses 48 and stabilizing screws 72 are provided on each stabilizing member 28. The bosses 48 may be formed in a variety of ways known in the art, including welding a nut to the stabilizing member 28 or machining the bosses 48 from the same integral body of material as the baseplate 26 and stabilizing member 28. Mounting holes (not shown) also may be located on the baseplate 26 for attaching a coaxial connector or other connector (not shown) or hardware to aid in the connection of a cable or similar conducting medium to the antenna 11. Threaded studs 56 extend from the top of the baseplate 26 in a pattern selected to match the pattern of mounting holes 58 in the antenna pedestal 12 or other object to be mounted. Each stud 56 is threaded to accept a mounting nut 74 for securing the antenna pedestal 12 or other object to the baseplate 26.

Still referring to FIGS. 2–3, the detachable section 16 is in the form of a generally L-shaped bracket 20 with one leg of the "L" forming an upward depending flange 36. The bracket flange 36 includes a plurality of holes 34*b* suitable for accepting screws, bolts or any other suitable connecting hardware. The bracket flange 36 is of substantially the same form as the baseplate flange 42. Extending from a second leg of the L-shaped bracket 20 is an extension arm 22 in the form of an elongated planar strip-like section. The extension arm 22 terminates at the end opposite the bracket flange 36 in a downward depending hook member 24*b*. The extension arm hook 24*b* is in substantially the same form as the baseplate hook 24*a*, having a leg 38*b* extending downwardly from and substantially normal to the extension arm 22 and a tab 40*b* extending inwardly toward the bracket 20, substantially normal to the leg 38*b*. The tab 40*b* is spaced from the extension arm 22 sufficiently to hook over an edge of the tile 14*a* at the upper edge 60*a*.

The apparatus of FIGS. 1–3 is mounted to the roof tile 14*a* as follows. To attach the mounting assembly 10 to a roof tile 14*a*, the detachable section 16 is placed relative to the tile 14*a* such that the extension arm hook 24*b* is positioned over the upper end 60*a* of the tile 14*a*, the tile 14*a* being received between the extension arm 22 and the associated tab 40*b*. In this placement, the extension arm 22 is located underneath the bottom surface of overlapping tile 14*b*, as shown in FIG. 1. The base section 18 is placed on top of the tile 14*a* with the baseplate hook 24*a* positioned over the lower end 64*a* of the tile 14*a*, the tile 14*a* being received between the baseplate 26 and the tab 40*a* on the baseplate hook 24*a*. The base section 18 is aligned with the detachable section 16 such that holes 34*a* in the baseplate flange 42 align with holes 34*b* in the bracket flange 36. The detachable section 16 and the base section 18 are clamped to the tile 14*a* by securing them together inserting a bolt 66 through each pair of aligned holes 34*a*, 34*b* and tightening a washer 68 and clamping nut 70 on each bolt 66. When tightened in this fashion, the bracket flange 36 and the baseplate flange 42 may or may not abut, depending on the length of the tile 14*a* and the length of the baseplate 26 and the extension arm 22. The stabilizing screws 72 are screwed into the threaded bosses 48 so that the stabilizing screws 72 extend through and below the stabilizing member 28. The stabilizing screws 72 are advanced to engage the tile 14*a* and substantially prohibit motion of the baseplate 26 relative to the tile 14*a*. To mount the antenna pedestal to the mounting assembly 10, the antenna pedestal 12 is placed on the baseplate 26 with the pedestal mounting holes 58 receiving the threaded studs 56 and is secured by screwing mounting nuts 74 onto the studs 56.

It is preferable to mount the assembly 10 of FIGS. 1–3 to a portion of a tile roof having a minimum of four tiles 14 that are horizontally interlocked with the mounted tile 14*a* and three tiles that are vertically interlocked with the tile 14*a*. For a tile roof that complies with the Jan. 1, 2002, design criteria published by the Roof Tile Institute, these interlocked tiles provide sufficient added weight for adequately anchoring the mounted tile 14*a* and the mounting assembly 10.

The apparatus of FIGS. 1–3 can be mounted to various types of tiles. While the tile 14*a* shown in FIGS. 1–2 is illustrated as a high profile, two channel tile, it will be understood that tiles having different profile curvature or depth can readily be accommodated by adjusting the stabilizing screws 72 during installation. Additionally, as will be apparent to one skilled in the art, the construction of the mounting assembly 10 can be altered to accommodate any style of roofing tile. For example the length of the hook legs 38*a*, 38*b* can be changed to accommodate tiles of different profile or thickness, the length of the extension arm 22 can be changed to accommodate tiles of different length, and the size and shape of the stabilizing members 28 can be changed to improve stability for a given type of tile.

Figure 4:
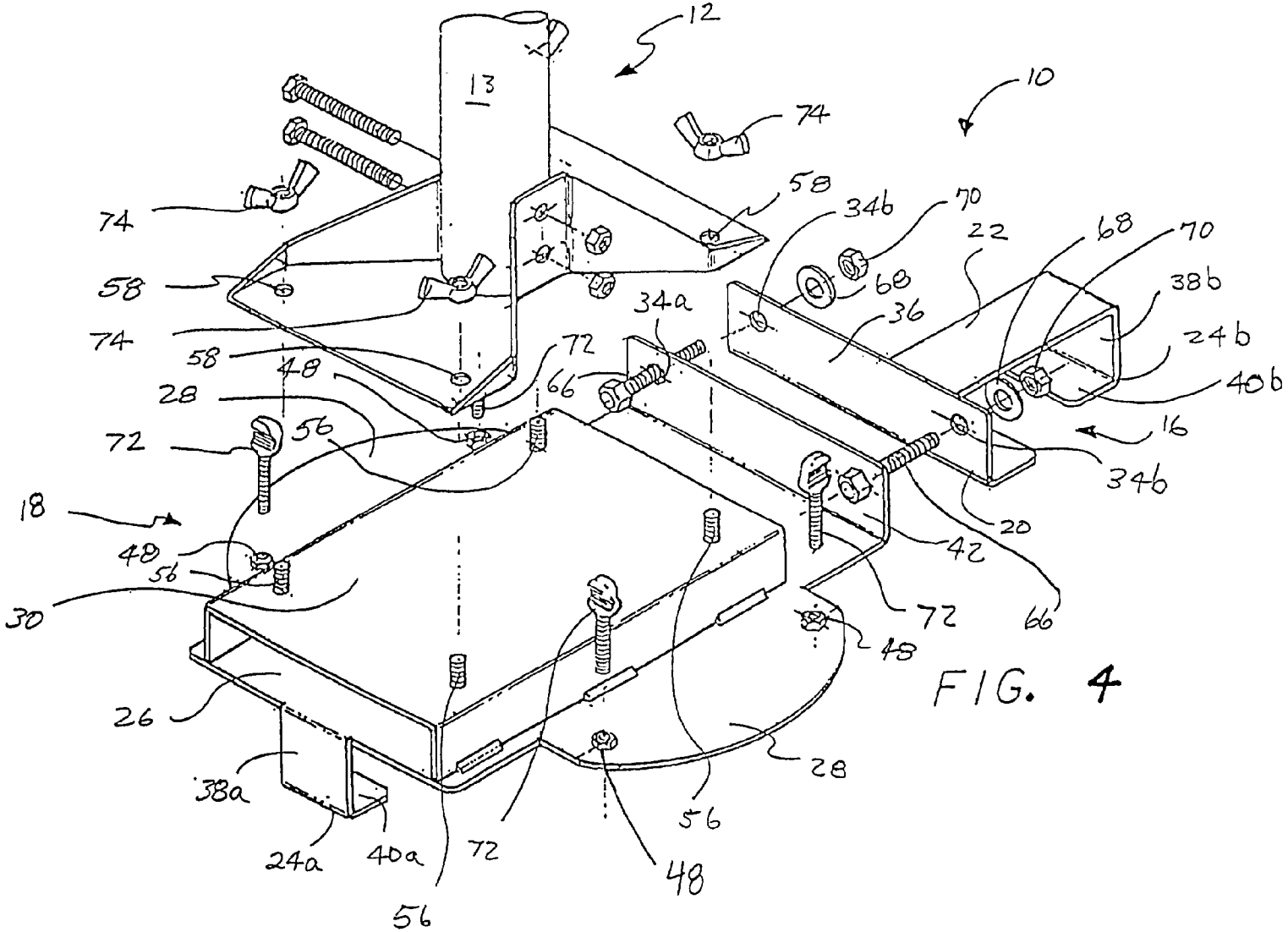
FIG. 4 shows an exploded perspective view of a second embodiment of a mounting assembly in accordance with the invention.

FIG. 4 illustrates a mounting assembly 10 according to the present invention having an alternative configuration for fixing the pedestal 12 to the baseplate 26. As shown in FIG. 4, a platform 30 is fixed to the top of the baseplate 26 for mounting the antenna pedestal 12 or other object. The platform 30 is formed as a shallow, inverted, U-shaped channel and is welded or affixed by other suitable means to the top surface of the baseplate 26. By forming the platform 30 in this manner, the platform 30 is disposed above the baseplate 26 to allow room between the platform 30 and the baseplate 26 for fixing a plurality of threaded studs 56 to the platform 30. By manufacturing the platform 30 as a separate piece, platforms can be manufactured to accommodate a variety of mounting hole patterns and attached to a standard baseplate 26 to adapt the mounting assembly 10 to those hole patterns.

Figure 5:
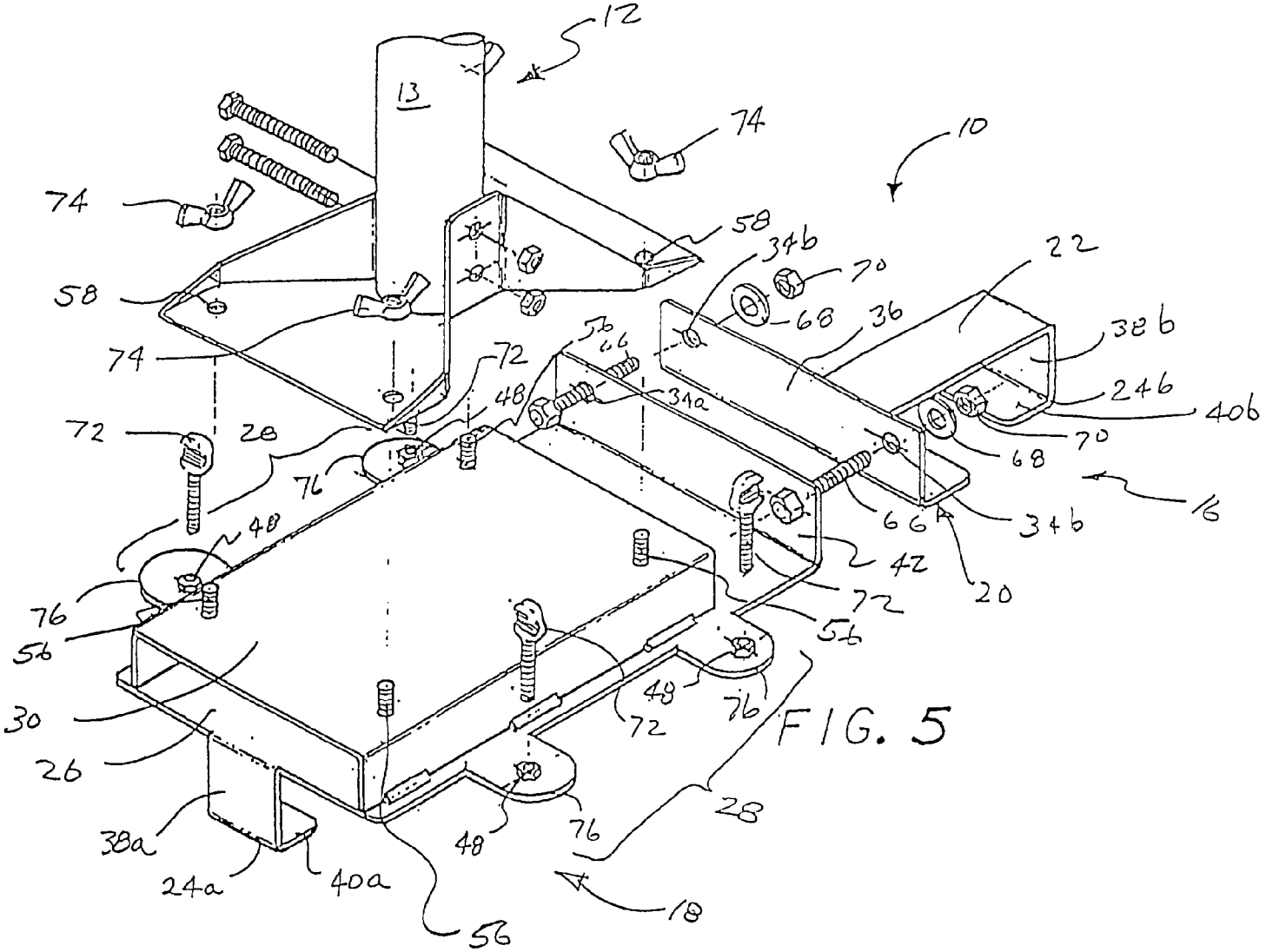
FIG. 5 shows an exploded perspective view of a third embodiment of a mounting assembly in accordance with the invention.

FIG. 5 illustrates another embodiment of a mounting assembly 10 according to the present invention having an alternative configuration of stabilizing elements 28. The apparatus of FIG. 5 includes a detachable section 16 and the base section 18 similar to that of the embodiment of FIGS. 1–3. The stabilizing elements 28 of the apparatus of FIG. 5, however, comprise a pair of stabilizing ears 76 extending from each side of the baseplate 26. One boss 48 is located on each stabilizing ear 76 for accepting the stabilizing screw 72. The mounting assembly of FIG. 5 is installed in the same fashion as previously described for the apparatus of FIGS. 1–3.

Figure 6:
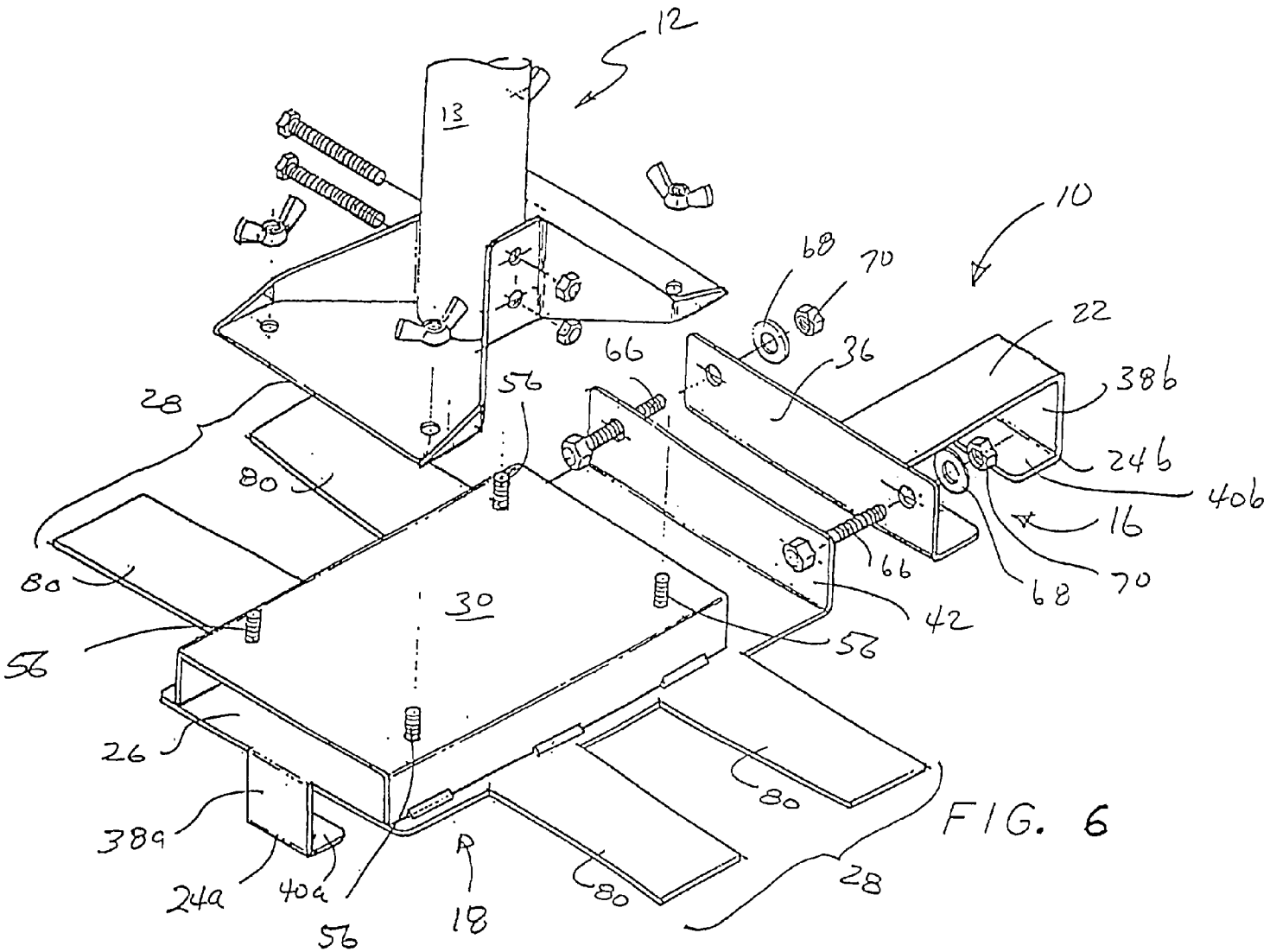
FIG. 6 shows an exploded perspective view of a fourth embodiment of a mounting assembly in accordance with the invention.

FIG. 6 depicts a third embodiment of a mounting assembly 10, according to the present invention, having yet another configuration of stabilizing elements 28. The apparatus of FIG. 6 includes the detachable section 16 and the base section 18 similar to that of the embodiment of FIG. 4. In the embodiment of FIG. 6, however, each stabilizing element 28 includes a pair of elongated stabilizing tongues 80 spaced apart from each other and extending laterally from the baseplate 26. Each stabilizing tongue 80 is disposed at an angle toward the tile 14*a* so that, when installed, the stabilizing tongue 80 engages the tile 14*a* and provides a positive spring force against the tile 14*a*, substantially eliminating movement of the mounting assembly 10 with respect to the tile 14*a*. This can be achieved by manufacturing the baseplate 26 and stabilizing tongues 80 from a sheet of metal so that they are coplanar. Before installation, the installer can bend the stabilizing tongues 80 downward by hand to provide the springlike effect described above.

Figure 7:
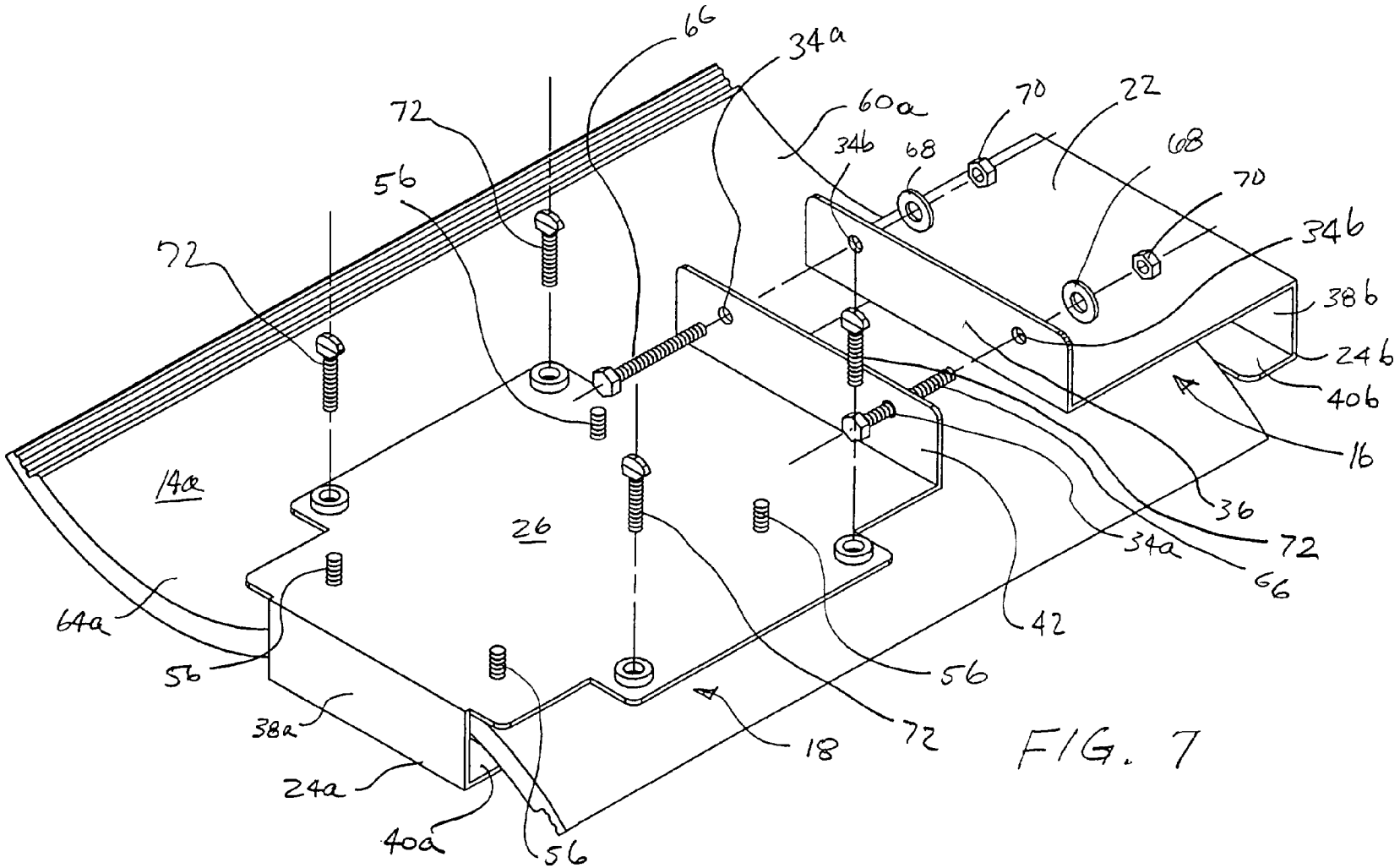
FIG. 7 shows an exploded perspective view of a fifth embodiment of a mounting assembly in accordance with the invention.

FIG. 7 illustrates another embodiment of a mounting assembly 10 according to the present invention wherein the leg 38*a* and the tab 40*a* of the baseplate hook 24*a* and the leg 38*b* and the tab 40*b* of the extension arm hook 24*b* are wider than in the previously disclosed embodiments. The apparatus of FIG. 7 includes a detachable section 16 and a base section 18 similar to that of the embodiments previously described. Lateral stability is provided by the wider configuration of the baseplate hook 24*a* and the extension arm hook 24*b*. As shown in FIG. 7, the baseplate 26 includes the stabilizing members 28. However, these stabilizing members may be omitted depending on the width of the legs 38*a*, 38*b* and the tabs 40*a*, 40*b* and the curvature of the tile. This embodiment, without the stabilizing members, is particularly effective for use with a roof tile that is flat or nearly flat across the width of the roof tiles such that the extension arm hook 24*b* and baseplate hook 24*a* can receive the tile thickness.

Still referring to FIG. 7, the mounting assembly 10 is attached to a tile 14*a* by positioning the extension arm hook 24*b* over the upper end of the tile 14*a*, with the extension arm hook 24*b* located beneath the overlapping tile 14*b*, and by positioning the baseplate hook 24*a* over the lower end 64*a* of the tile 14*a*, similar to the installation of the previously described embodiments of the mounting assembly 10. The detachable section 16 and the base section 18 are secured by bolting the baseplate flange 42 and the bracket flange 36 together in the manner previously desribed. When the mounting hardware is secured, relative movement of the mounting assembly 10 with respect to the flat tile 14*a* is essentially eliminated.

Figure 8:
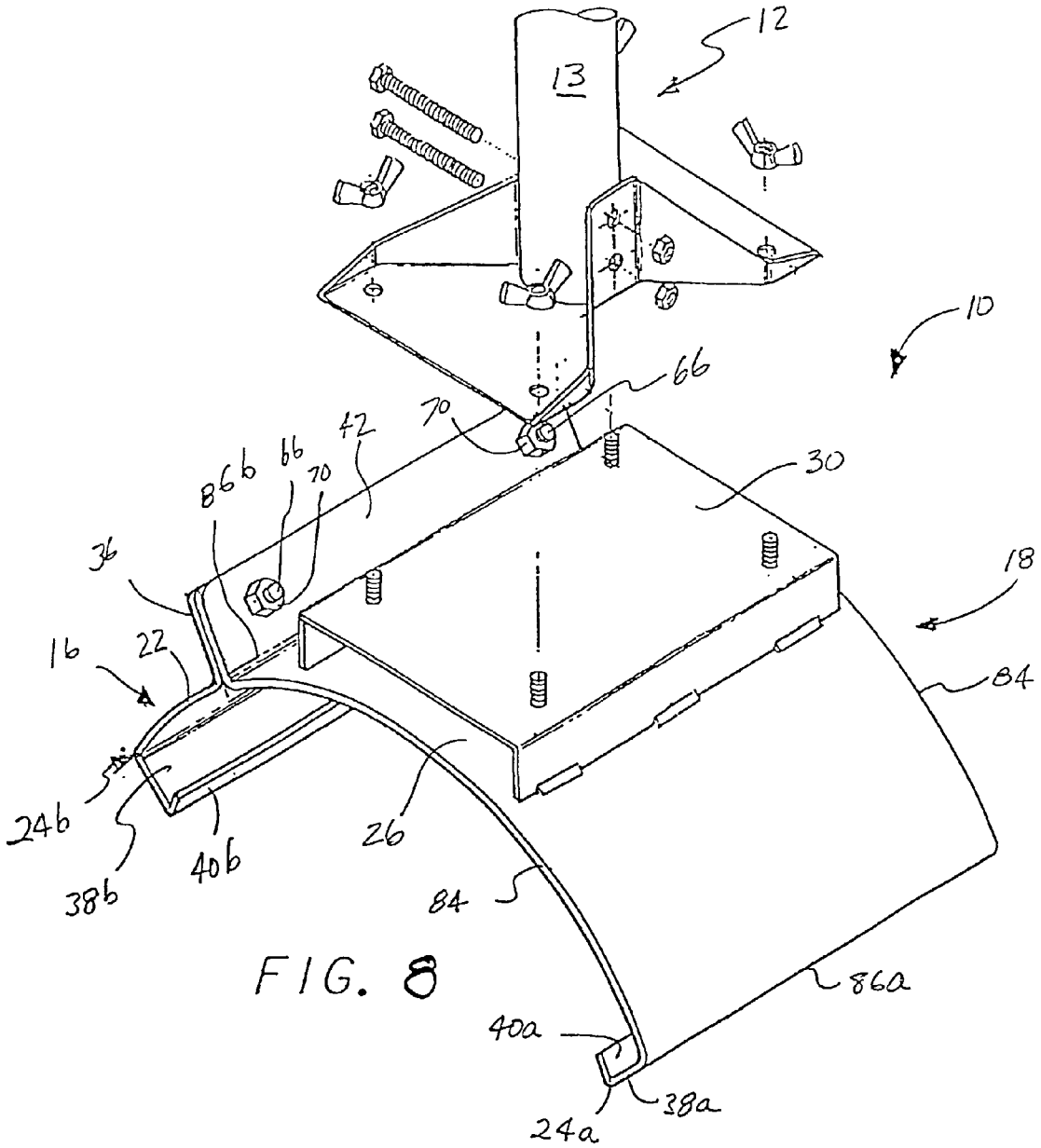
FIG. 8 shows an exploded perspective view of a sixth embodiment of a mounting assembly in accordance with the invention.

FIG. 8 shows a fifth embodiment of a mounting assembly 10 in accordance with the present invention for mounting an object to a partial round tile or cap tile (not shown). This type of tile is typically used to cover the discontinuity in a roof formed by the intersection of two flat roof sections. The mounting assembly 10 of FIG. 8 includes a detachable section 16 and a base section 18. The base section 18 includes a curved baseplate 26 having two opposing curved sides 84 and two opposing straight sides 86. The baseplate 26 has a downward depending hook member 24*a* along one straight side 86*a* and an upward depending flange 42 along the opposing straight side 86*b*. The baseplate hook 24*a* comprises a leg 38*a* extending downwardly from and substantially normal to the baseplate 26 and a tab 40*a* extending inwardly toward the baseplate flange 42, substantially normal to the leg 38*a*. The tab 40*a* is spaced from the baseplate 26 sufficiently to hook over a straight edge of the cap tile. The baseplate flange 42 extends generally normal to and upwardly from the baseplate 26 and includes a plurality of holes for accepting screws, bolts 66 or any other suitable connecting hardware. The platform 30 is fixed to the top of the baseplate 26 for mounting the antenna pedestal 12 or other object. The platform 30 is in a configuration similar to that previously described.

Still referring to FIG. 8, the detachable section 16 is in the form of a generally L-shaped bracket 20 with one leg of the "L" forming the upward depending flange 36. The bracket flange 36 includes a plurality of holes suitable for accepting screws, bolts 66 or any other suitable connecting hardware. The bracket flange 36 is of substantially the same form as the baseplate flange 42. Extending from a second leg of the L-shaped bracket 20 is a short extension arm 22 in the form of a planar section that is curved to conform to the curvature of the cap tile. The extension arm 22 terminates at the end opposite the bracket 20 in a downward depending hook member 24*b*. The extension arm hook 24*b* is in substantially the same form as the baseplate hook 24*a*, having a leg 38*b* extending downwardly from and substantially normal to the extension arm 22 and a tab 40*b* extending inwardly toward the baseplate 26, substantially normal to the leg 38*b*. The tab 40*b* is spaced from the extension arm 22 sufficiently to hook over an edge of the cap tile.

Still referring to FIG. 8, the baseplate 26 is sized to laterally span the majority of the half round or cap tile to which it will be mounted and is shaped such that the curvature of the baseplate 26 substantially mirrors the curvature of the tile. To attach the mounting assembly 10 to the cap tile, the detachable section 16 is placed relative to the tile such that the extension arm hook 24*b* is positioned over a straight edge of the tile, the tile being received between the extension arm 22 and the associated tab 40*b*. The base section 18 is placed on top of the tile with the baseplate hook 24*a* positioned over the opposing straight edge of the tile, the tile being received between the baseplate 26 and the tab 40*a* on the baseplate hook 24*a*. The base section 18 is aligned with the detachable section 16 such that holes 34*a* in the baseplate flange 42 align with holes 34*b* in the bracket flange 36. The detachable section 16 and the base section 18 are clamped to the tile by securing them together inserting a bolt 66 through each pair of aligned holes 34*a*, 34*b* and tightening a washer 68 and clamping nut 70 over the each bolt 66. When tightened in this fashion, the bracket flange 36 and the baseplate flange 42 may or may not abut, depending on the width of the tile and the size of the baseplate 26 and the extension arm 22. To mount the antenna pedestal 12 to the mounting assembly 10, the antenna pedestal 12 is mounted on the platform 30 in the manner previously described.

Figure 9:
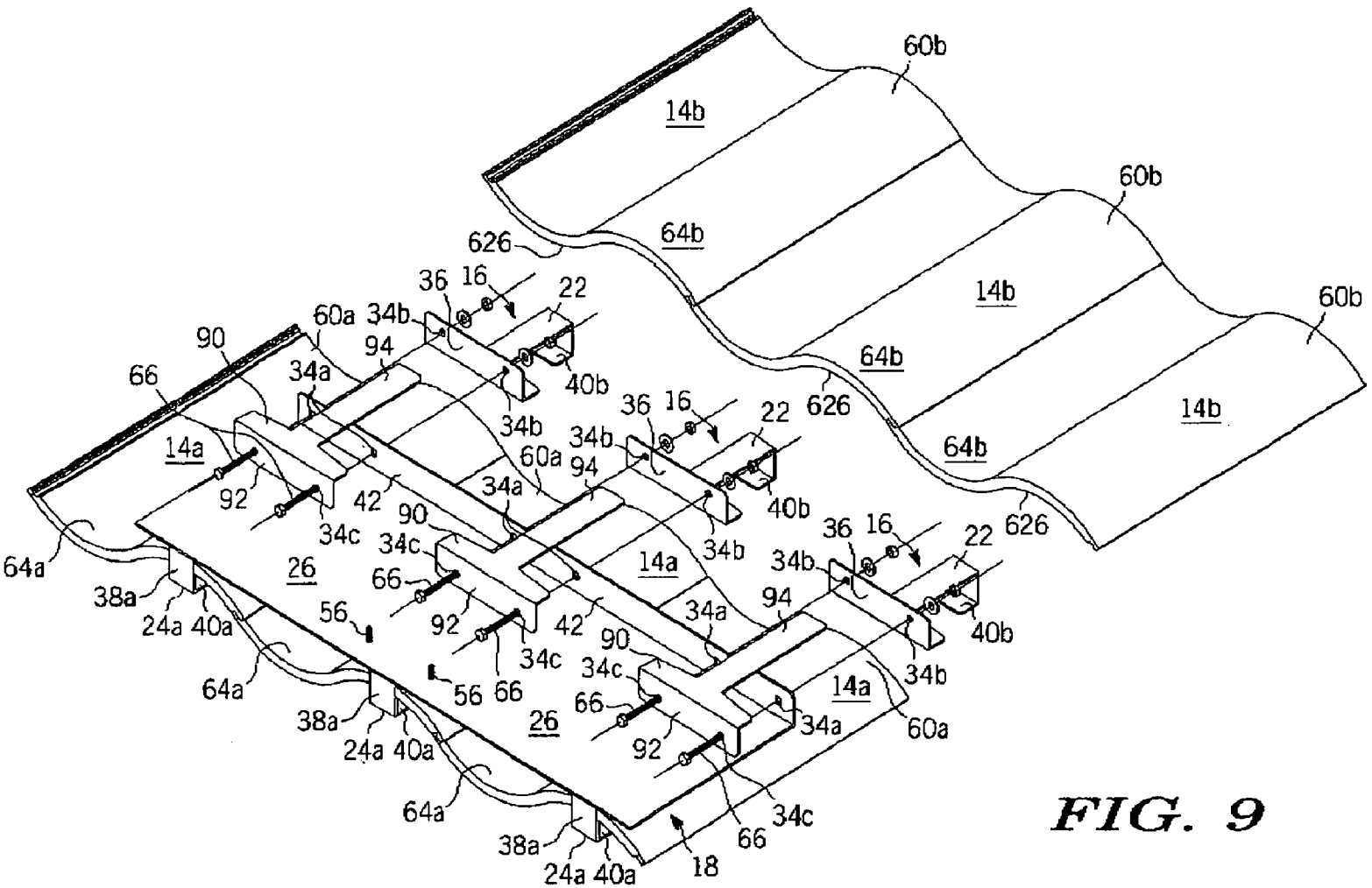
FIG. 9 shows an exploded perspective view of a seventh embodiment of a mounting assembly for mounting to multiple tiles of a roof in accordance with the invention.
Figure 10:
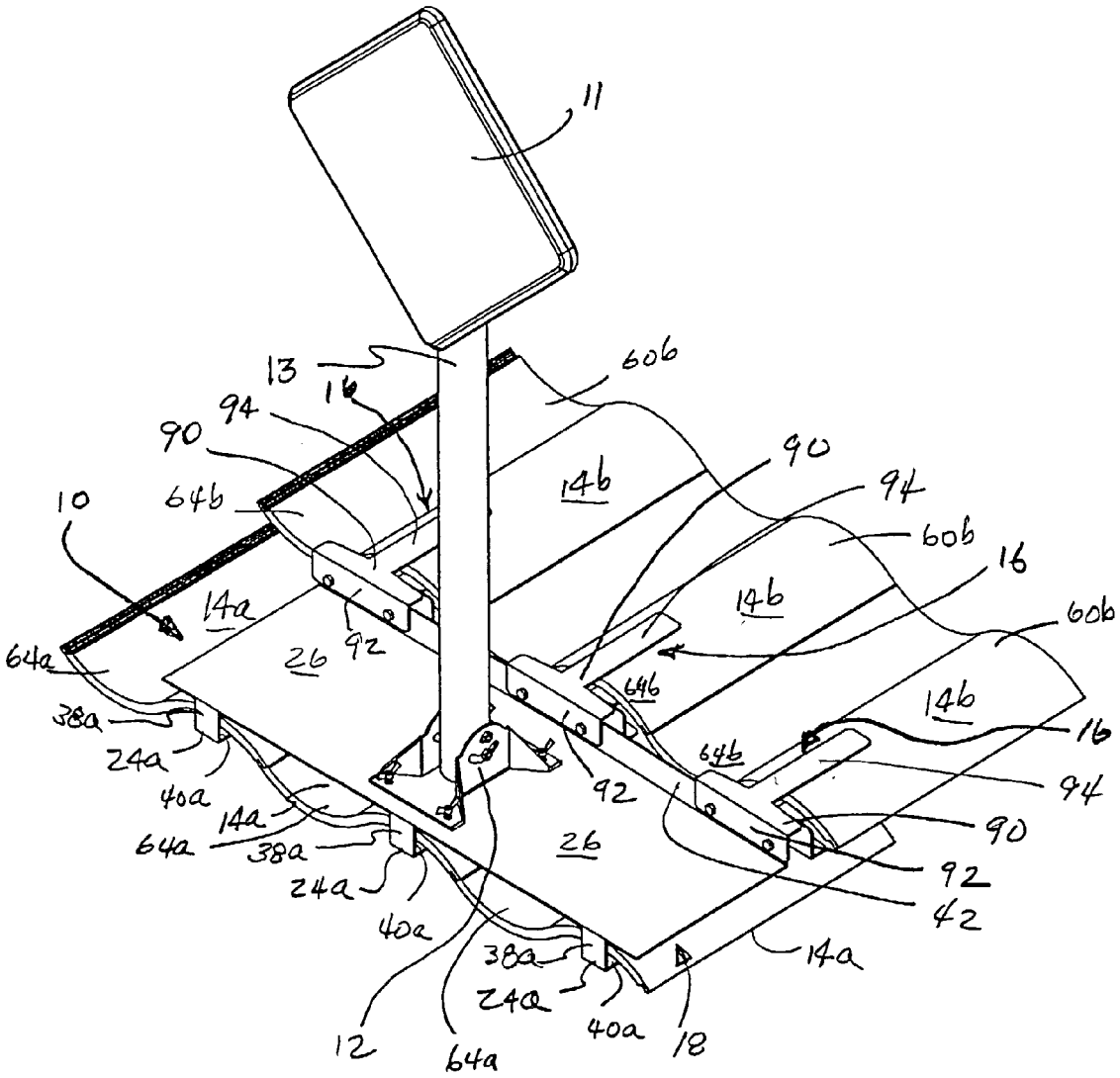
FIG. 10 is a perspective view illustrating the mounting assembly of FIG. 9 mounted to multiple tiles of a roof.

FIGS. 9–10 show an embodiment of a mounting assembly 10 according to the present invention for mounting an object, such as an antenna, to multiple tiles 14*a*. This multiple tile embodiment provides improved support, both laterally across the pitch of the roof and longitudinally along the pitch of the roof. The mounting assembly 10 clamps to a plurality of roof tiles 14*a* and engages a plurality of the overlapping roof tiles 14*b* to provide improved support for those cases where more stability is desired. One such case where improved stability may be desired is the mounting of a small aperture antenna on a longer support pole. This configuration results in an increased wind load compared to the wind load on configurations with shorter antenna poles.

The mounting assembly 10 shown in FIG. 9 comprises a base section 18 and a plurality of detachable sections 16. The base section 18 includes a baseplate 26 that is wide enough to span portions of a plurality of tiles 14*a*. In the exemplary embodiment shown in FIG. 9, the baseplate 26 is shown spanning the major portion of three roof tiles 14*a*. It will be understood, however, that the baseplate 26 can be sized span and be mounted to fewer than three tiles or more than three tiles. The baseplate 26 has a plurality of downward depending hook members 24*a* at one end and an upward depending flange 42 at the opposing end. Each baseplate hook 24*a* is similar to that previously described for the embodiment of FIGS. 2–3, including the leg 38*a* extending downwardly from and substantially normal to the baseplate 26 and the tab 40*a* extending inwardly toward the baseplate flange 42, substantially normal to the leg 38*a*. Each tab 40*a* is spaced from the baseplate 26 sufficiently to hook over an edge of the tile 14*a*. The baseplate flange 42 extends generally normal to and upwardly from the baseplate 26 and substantially spans the width of the baseplate 26. The baseplate flange 42 and includes a plurality of holes 34*a* for accepting screws, bolts or any other suitable connecting hardware. Groupings of holes 34*a* in the baseplate flange 42 are located to match the pattern of holes 34*b* in one of the detachable sections 16. The object to be mounted upon the tile roof, which is represented in FIG. 10 by the antenna pedestal 12, is secured to the baseplate 26 using studs 56 as previously described. Although FIG. 10 shows a single pedestal 12 mounted to the baseplate 26, it will be understood that multiple pedestals 12 can be mounted the the baseplate 26, depending on its size, by providing additional studs 56 appropriately positioned on the baseplate 26.

Each of the detachable sections 16 is in a form like that previously described with respect to FIGS. 2–3. The number of detachable sections 16 preferably matches the number of baseplate hooks 24*a*. The illustrative example of FIG. 9 demonstrates an embodiment of the mounting assembly 10 in which there are three detachable sections 16. A stiffener element 90 is provided for each detachable section 16. Each stiffener 90 is in the form of a generally L-shaped bracket with one leg of the "L" forming a stiffener flange 92. The stiffener flange 92 has holes 34*c* for accepting the connecting screws, bolts, or other similar fastening devices used to connect the base section 18 and the detachable section 16. The pattern of the holes 34*c* matches the pattern of holes 34*b* in the bracket flange 36 and the pattern of the holes 34*a* in the baseplate flange 42. The second leg of the L-shaped stiffener 90 includes a tongue 94 in the form of an elongated planar strip-like section extending from the stiffener flange 92.

FIG. 10 depicts the mounting assembly 10 of FIG. 9 attached to a plurality of roof tiles 14*a* and holding an antenna 11. The mounting assembly 10 is attached to the roof tiles 14*a* by placing the detachable sections 16 on adjacent tiles 14*a* such that extension arm hooks 24*b* fit over the upper ends 60*a* of the tiles 14*a*, each tile 14*a* being received between the extension arm 22 and the tab 40*b* of one of the extension arm hooks 24*b*. The extension arms 22 are located underneath the bottom surfaces 62*b* of overlapping tiles 14*b*. The base section 18 is placed over the tiles 14*a* such that the baseplate hooks 24*a* fit over the lower ends 64*a* of the tiles 14*a*, the tiles 14*a* being received between the baseplate 26 and the tabs 40*a* on the baseplate hooks 24*a*. The base section 18 is aligned with the detachable sections 16 such that holes 34*a* in the baseplate flange 42 align with holes 34*b* in the bracket flanges 36. Each stiffener 90 is located relative to the base section 18 such that the holes 34*c* in the stiffener flange 92 align with corresponding holes 34*a* in the baseplate flange 42 and each stiffener tongue 94 is located above the corresponding overlapping tile 14*b*. Each stiffener flange 92 is located so that it overlaps the baseplate flange 42 on the side of the flange 42 proximate the studs 56. The detachable section 16 and the base section 26 are clamped to the tile 14*a*, and the stiffener 90 is secured in place with the tongue 94 extending over the corresponding overlapping tile 14*b*, by inserting bolts 66 through the aligned holes 34*a*, 34*b*, 34*c* and tightening a washer 68 and clamping nut 70 over each bolt 66.

It will be understood that, although the mounting assembly 10 shown in FIGS. 9–10 has three each of the baseplate hook 24*a*, the detachable section 16, and the stiffener 90, and the baseplate 26 extends over three roof tiles 14*a*, there are a variety of combinations for which the extended mounting assembly 10 may be implemented. For example, the baseplate 26 may span two roof tiles 14*a* and include two baseplate hooks 24*a* to be used in conjunction with two each of the detachable section 16 and the stiffener 90. As another example, the mounting assembly may substantially span three roof tiles 14*a*, but may have two baseplate hooks 24*a*, two detachable sections 16, and two stiffeners 90, omitting the intermediate baseplate hook 24*a*, detachable section 16, and stiffener 90. As an additional example that may be used with narrower roof tiles, the mounting assembly 10 may substantially span four tiles, for example, to provide improved support. As yet another example, the assembly 10 may be adapted so that multiple pedestals 12 can be mounted to the baseplate 26.

It is preferable to mount the assembly 10 of FIGS. 9–10 to a portion of a tile roof having a minimum of two tiles that are horizontally interlocked with the mounted tiles 14*a* and three tiles that are vertically interlocked with the tiles 14*a*. For a tile roof that complies with the Jan. 1, 2002, design criteria published by the Roof Tile Institute, these interlocked tiles provide added weight for adequately anchoring the mounted tiles 14*a* and the mounting assembly 10.

The stiffener 90 employed in the embodiment of the present invention illustrated in FIGS. 9–10 may be similarly employed to provide additional longitudinal support for the embodiments of the mounting assembly 10 shown in FIGS. 1–7.

Prototypes of each of the embodiments of the mounting assembly 10 discussed herein have been manufactured primarily from mild steel. However, the mounting assembly 10 may be manufactured using any other suitable material known in the art, including sheet aluminum alloy of the appropriate thickness or steel and aluminum used in combination. The base sections 18 of the embodiments shown in FIGS. 1–10 are preferably produced using standard sheet metal fabrication techniques known in the art. For embodiments including the platform 30, the platform 30 is preferably attached using standard welding procedures, but may also be secured by other means known in the art, such as screwing, riveting or bolting via tabs added to the platform 30. The detachable sections 16 of the embodiments of FIGS. 1–10 and the stiffener 90 of FIG. 9 are preferably integrally formed from a single piece of mild steel using standard sheet metal fabrication techniques. They also may be fabricated from any similarly suitable material, such as aluminum alloy sheet of the appropriate thickness, using a variety of techniques known in the art. All embodiments of the invention described herein are preferably finished using powder coating, but may be finished using a variety of methods known in the art including painting with epoxy or any other suitable paint.

From the foregoing, it can be seen that the mounting apparatus and method according to the invention possesses a number of advantages. It provides a method for mounting objects to a tile roof and is adaptable to a wide variety of tile shapes and styles. These objects can be mounted using a standard installation technique that is easily, quickly, and affordably performed. The mounting apparatus is lightweight yet provides excellent support and stability for rooftop-mounted objects without modification of the roof tiles or damage to the tiles or to the roof structure. The mounting assembly is aesthetically pleasing and eliminates unsightly installations that are unacceptable to homeowners and to bodies such as homeowners' associations that monitor and enforce architectural restrictions.

What is claimed is:

1. A mounting assembly for securing an apparatus to a roof tile, wherein the roof tile includes a first edge and a second edge comprising:

a baseplate suitably adapted to engage a roof tile, the baseplate having a surface, a first end and an opposing second end, a first stabilizing member and a laterally opposing second stabilizing member extending from and coplanar to the surface of the baseplate, a first hook member contiguous with and part of the first end of the baseplate with the first hook member extending downward from the baseplate to receive the first edge of the roof file, and a first flange contiguous with and part of the second end of the baseplate with the first flange extending in an upward direction from the second end, the stabilizing members include a threaded boss disposed at a lateral portion of the stabilizing members and adapted to receive a stabilizing screw; and a detachable bracket having a second flange member, an extension arm having a first end and a second end, and a second hook member, the second flange member contiguous with and part of the extension arm of the detachable bracket with the second flange member extending upward and a second hook member contiguous with and part of the second end of the extension arm with the second hook member extending downward to receive the second edge of the roof tile, and wherein the first flange of the baseplate and the second flage of the detachable bracket are capable of being pulled together to move the baseplate with the first hook member and the detachable bracket with the second hook member together to clamp the baseplate to the roof tile.

2. The mounting assembly of claim 1 wherein the first hook member extends along a majority of the length of the baseplate first end.

3. The mounting assembly of claim 1 wherein the baseplate further includes a pedestal attached to the surface of the baseplate.

4. A mounting assembly for a roof tile having a first edge and a second edge comprising:

a baseplate suitably adapted to engage a roof tile, the baseplate having a surface, a first end and an opposing second end, a first side and an opposing second side, a first hook member contiguous with and part of the first end of the baseplate with the first hook member extending downward from the baseplate to receive a first edge of the roof tile, and a first flange contiguous with and part of die second end of the baseplate with the first flange extending in an upward direction from the second end;

a first stabilizing member and a laterally opposing second stabilizing member extending from the first and second sides including threaded bosses for receiving a stabilizing screw, respectively, and coplanar to the surface of the baseplate; and a detachable bracket having a second flange, an extension arm having a first end and a second end, and a rigidly affixed second hook member, the second flange contiguous with and upwardly extending from the first end of the extension arm to receive the first flange member of the baseplate and the second hook contiguous with and part of the extension arm and extending from the second end of the extension arm to receive the second edge of the roof tile, and wherein the first flange of the baseplate and the second flange of the detachable bracket are capable of being pulled together to move the baseplate with the first hook member and the detachable bracket with the second hook member together to clamp the baseplate to the roof tile.

5. A method for securing a mounting assembly to a roof tile having a first edge and an opposing second edge comprising the steps of:

providing a baseplate suitably adapted to engage a roof tile, the baseplate having a surface, a first end and an opposing second end, a first side and an opposing second side, a first hook member, a first stabilizing member and a laterally opposing second stabilizing member extending from the first and second sides including threaded bosses for receiving a stabilizing screw, respectively, and coplanar to the surface of the baseplate, and a first flange member, the first hook member contiguous with and part of the first end of the baseplate with the first hook member extending downward from the baseplate and adapted to receive a first edge of the roof tile, the first flange member contiguous with and part of the second end of the baseplate with the first flange member extending upward from the baseplate;

providing a detachable bracket having a second flange, an extension arm with a third end and an opposing fourth end, and a second hook member, the second flange contiguous with and part of the third end of the extension arm extending upward from the extension arm of the detachable bracket and the second hook member contiguous with and part of the fourth end of the extension arm extending downward from the extension arm of the detachable bracket and adapted to receive a second edge of the roof tile;

positioning the baseplate and the detachable bracket on the roof die so that the first hook member receives the first edge of the roof tile and the second hook member receives the second edge of the roof tile with the first and second flange members in a proximal positions; and pulling the first and second flange members together to move the baseplate wit the first hook member and the detachable bracket wit the second hook member together to clamp the baseplate on the die.

6. A mounting assembly for securing a mounting pedestal to a roof tile having a first edge, an opposing second edge, lateral edges, and a top surface that faces generally upward when the tile is positioned on a roof, the mounting assembly comprising:

a baseplate having a surface, first end and an opposing second end, a first hook member contiguous with and part of the first end of the baseplate and extending downward from the first end of the baseplate and adapted to receive the first edge of the roof tile, a first flange member contiguous wit and part of the second end of the baseplate and extending upward from the baseplate;

a bracket adapted to be detachably mounted to the baseplate, the bracket having a second flange member, an extension arm having a first end and a second end, and a second hook member contiguous with and part of the first end of the extension arm with the second hook member adapted to receive the second edge of the roof tile, the second flange contiguous with and part of the extension arm, and wherein the first flange of the baseplate and the second flange of the detachable bracket are capable of being pulled together to move to baseplate with the first hook member and the bracket with the second hook member together to clamp the baseplate to the root tile;

means for mounting the mounting pedestal to the baseplate; and means for stabilizing the baseplate laterally when it is mounted to the roof tile, wherein the means for stabilizing the baseplate includes a threaded boss disposed at a lateral portion of the baseplate and adapted to receive a stabilizing screw.

7. A mounting assembly for securing a mounting pedestal to a roof tile having a first edge, an opposing second edge, lateral edges, and a top surface that faces generally upward when the tile is positioned on a roof, the mounting assembly comprising:

a baseplate having a first end and an opposing second end, a first hook member contiguous with and part of the first end of the baseplate arid extending downward from the first end of the baseplate and adapted to receive the first edge of the roof tile, a first flange member contiguous with and part of the second end of the baseplate and extending upward from the baseplate the baseplate having a stabilizer being threaded bosses on a lateral portion thereof for receiving a stabilizing screw;

a bracket adapted to be detachably mounted to the baseplate, the bracket having a second flange member, an extension arm having a first end and a second end, and a second hook member contiguous with and part of the first end of the extension arm with the second hook member adapted to receive the second edge of the roof tile, the second flange member contiguous with and part of the second end of the extension arm, and wherein the first flange of the baseplate and the second flange of the detachable bracket are capable of being pulled together to move the baseplate with the first hook member and the detachable bracket with the second hook member together to claim the baseplate to the roof tile;

a pedestal capable of being mounted to the baseplate; and means for mounting the pedestal to the baseplate, wherein the means for mounting the pedestal to the baseplate includes a plurality of studs fixed to the baseplate and adapted to be secured to the antenna pedestal.

8. The mounting assembly of claim 7 wherein the plurality of studs comprise a plurality of threaded studs and the pedestal includes a plurality of mounting holes configured to receive the plurality of threaded baseplate studs.

* * * * *